United States Patent [19]

Townsend

[11] Patent Number: 4,824,691

[45] Date of Patent: Apr. 25, 1989

[54] IMAGED MICROCAPSULE-COATED PAPER

[75] Inventor: Leslie Townsend, Chesham, England

[73] Assignee: The Wiggins Teape Group Limited, Basingstoke, England

[21] Appl. No.: 29,962

[22] Filed: Mar. 25, 1987

[30] Foreign Application Priority Data

Mar. 27, 1986 [GB] United Kingdom ..... 8607689

[51] Int. Cl.[4] ..... B05D 3/06; B41M 3/12

[52] U.S. Cl. ..... 427/53.1; 427/145; 427/146; 162/110; 162/124; 156/643

[58] Field of Search ..... 427/53.1, 145, 146; 428/321.3, 321.5, 908, 913; 162/110, 124; 156/643

[56] References Cited

U.S. PATENT DOCUMENTS

| | | | |
|---|---|---|---|
| 3,186,861 | 6/1965 | Smith et al. | 428/321.5 |
| 3,256,524 | 6/1966 | Stauffer . | |
| 3,943,324 | 3/1976 | Haggerty . | |
| 3,958,253 | 5/1976 | Rueckmann . | |
| 4,024,545 | 5/1977 | Dowling et al. . | |
| 4,118,619 | 10/1978 | McArthur et al. . | |
| 4,121,595 | 10/1978 | Heitmann et al. . | |
| 4,240,448 | 12/1980 | Heitmann et al. . | |
| 4,302,654 | 11/1981 | Bennett et al. . | |
| 4,356,375 | 10/1982 | Josephy et al. . | |
| 4,378,480 | 3/1983 | Langhans . | |
| 4,397,483 | 8/1983 | Hiraishi et al. | 428/321.5 |
| 4,401,992 | 8/1983 | Vorst et al. . | |
| 4,496,961 | 1/1985 | Devrient | 162/124 |
| 4,499,361 | 2/1985 | Brinker . | |
| 4,499,362 | 2/1985 | Martin . | |
| 4,507,535 | 3/1985 | Bennett et al. . | |
| 4,519,680 | 5/1985 | Grollimund . | |
| 4,537,809 | 8/1985 | Ang et al. . | |
| 4,568,815 | 2/1986 | Kimbara et al. . | |
| 4,612,555 | 9/1986 | Hongon et al. . | |
| 4,612,556 | 9/1986 | Pinot de Moira | 428/321.5 |
| 4,740,269 | 4/1988 | Berger et al. . | |

FOREIGN PATENT DOCUMENTS

| | | |
|---|---|---|
| 27698 | of 0000 | European Pat. Off. . |
| 47604 | of 0000 | European Pat. Off. . |
| 0021165 | 1/1981 | European Pat. Off. . |
| 0042173 | 10/1982 | European Pat. Off. . |
| 0119034 | 9/1984 | European Pat. Off. . |
| 3431577 | of 0000 | Fed. Rep. of Germany . |
| 2820462 | 3/1979 | Fed. Rep. of Germany . |
| 3418188 | 9/1987 | Fed. Rep. of Germany . |
| 2158921 | 6/1973 | France . |
| WO87/05850 | 10/1987 | PCT Int'l Appl. . |
| 2131767 | of 0000 | United Kingdom . |
| 2127567 | of 0000 | United Kingdom . |
| 2133352 | of 0000 | United Kingdom . |
| 2173452 | of 0000 | United Kingdom . |
| 1603752 | of 0000 | United Kingdom . |
| 2022492 | of 0000 | United Kingdom . |
| 2027628 | of 0000 | United Kingdom . |
| 2032323 | of 0000 | United Kingdom . |
| 2170504 | of 0000 | United Kingdom . |
| 2022987 | of 0000 | United Kingdom . |
| 2143649 | of 0000 | United Kingdom . |
| 2144873 | of 0000 | United Kingdom . |
| 1128616 | 9/1968 | United Kingdom . |
| 1405487 | 9/1975 | United Kingdom . |
| 2032325 | 5/1980 | United Kingdom . |
| 1569725 | 6/1980 | United Kingdom . |
| 2044175 | 10/1980 | United Kingdom . |
| 1588980 | 5/1981 | United Kingdom . |
| 2074493 | 11/1981 | United Kingdom . |
| 1602133 | 11/1981 | United Kingdom . |
| 2094211 | 9/1982 | United Kingdom . |
| 2101029 | 1/1983 | United Kingdom . |
| 2113142 | 8/1983 | United Kingdom . |
| 2118882 | 11/1983 | United Kingdom . |
| 2126955 | 4/1984 | United Kingdom . |
| 2137068 | 10/1984 | United Kingdom . |
| 2149644 | 6/1985 | United Kingdom . |
| 2161752 | 1/1986 | United Kingdom . |

OTHER PUBLICATIONS

"Fast Laser Pulses Can Etch a Pattern in a Moving Part on a Production Line", Laser Focus, Jul. 1975, p. 78.

"Neodymium Yttrium Aluminum Garnet (Nd: YAG) Laser Marking System" SPIE vol. 247, *Advances in Laser Engineering and Application* (1980) , p. 18.

*Dagens Industri,* vol. 7, No. 118, Nov. 23, 1983, p. 42.

"The Advance of Laser Coding", Dr. Greg Sharp--Dent, *Packaging,* Jul. 1983.

Article, *Xerox Disclosure Journal,* vol. 5, No. 2, Mar.-/Apr. 1980.

"Product Marking with ND:YAG and $CO_2$ Lasers", M. J. Weiner, SPIE vol. 86 *Industrial Application of High Power Laser Technology* (1976), p. 23.

"Lasers-a Cut Above the Rest", Dr. Ian Spalding, *Lin-d-Up,* Jan.-Mar. 1986.

Article, *Financial Times.*

"Laser Mark", Lumonics.

"Laser Brand", Material from Laser Applications.

"Simply Code it With Laserprint", Material from Laserprint.

IBM Technical Disclosure Bulletin, vol. 14, No. 5, Oct. 1971.

*Primary Examiner*—Herman Morgenstern
*Assistant Examiner*—Margaret Bueker
*Attorney, Agent, or Firm*—Burns, Doane, Swecker & Mathis

[57] ABSTRACT

Imaged microcapsule-coated paper, e.g. pressure-sensitive copying paper, is produced by imaging paper by means of laser energy and then applying a coating of microcapsules over the image. The image may be a manufacturer's name, logo or trademark, and may be applied at high speed on the paper machine on which the paper is produced or on the coating machine used to apply the microcapsule coating.

10 Claims, No Drawings

IMAGED MICROCAPSULE-COATED PAPER

This invention relates to the production of imaged microcapsule-coated paper by a method not involving the application of ink or other marking material, and to imaged microcapsule-coated paper produced by this method. The microcapsule-coated paper may for example be pressure-sensitive copying paper.

Pressure-sensitive copying paper frequently reaches the end user through the intermediary of a printer or other converter, rather than direct from the manufacturer. The end user may therefore receive the product in the converter's packaging and labels, rather than those of the manufacturer. This tends to lessen the effectiveness of the manufacturer's advertising, and to prevent the manufacturer from capitalising on goodwill generated by previous satisfactory use of the manufacturer's product. It would therefore be advantageous from the manufacturer's point of view if the microcapsule-coated paper could be imaged, for example with the manufacturer's name, logo or trademark, without this image interfering with subsequent operations to be carried out on the paper, for example printing or writing or with the functional performance of the paper.

It has now been found that this objective may be achieved by using laser energy to image the paper on one of its surfaces and then applying a microcapsule coating over the image so formed. The image formed by the laser energy is not erased by the application of a wet microcapsule coating and has been found to be visible through the dry microcapsule coating on the finished product.

The use of laser energy is advantageous in that it permits imaging of the paper at high speed, and in particular at the speed at which the paper is produced on the papermachine or the speed at which the paper is coated with microcapsules, so facilitating "on-machine" operation. A further advantage is that laser imaging does not require the paper to be contacted by an imaging member such as a printing roll. Thus there is no risk of contamination by stray marking fluid, and paper feeding is made simpler.

The use of laser energy for imaging various materials is known in itself, for example in the field of packaging to apply date or production codes or "sell by" or "best before" dates to inked or painted metal cans, glass or plastics bottles, plastics films, and paper labels which carry ink or other coating materials all over their exposed surface. More generally, an article entitled "Fast laser pulses can etch a pattern in a moving part on a production line" in "Laser Focus", July 1975 issue, at pages 28 to 33, discloses that "such non-metals as plastic, wood, paper, paint and glasses are highly absorbent" (with respect to laser energy). However, there is nothing in the prior art just discussed which discloses or suggests the potential of laser marking for meeting the objective set out above, or discloses that the image formed may subsequently be coated with microcapsules and yet remain clearly visible.

Accordingly, the present invention provides a method of producing an imaged microcapsule-coated paper comprising the steps of imaging one surface of a paper substrate by the application of laser energy and then applying a microcapsule coating to said one surface of the paper substrate so as to cover, but not obscure, the image produced by the laser energy.

The laser energy may be supplied by means of a pulsed laser, or a continuous wave laser, typically a carbon dioxide laser in each case.

The images produced by the present method may be visible or discernible in transmitted or reflected light or both, depending on the conditions under which they are produced (pulsed or continuous wave laser energy, energy level, paper type, etc.).

The image may be produced by positioning a suitably-apertured mask plate or stencil in the path of the emitted laser energy, so as to obtain an image corresponding to the configuration of the aperture(s). Normally a focussing lens or mirror is used to focus the energy on to the paper to be imaged, although the extent of focussing required will depend on the power of the laser used and the characteristics of the paper being imaged. If too much energy is applied, paper damage, i.e. undesirable lifting of fibres from the paper surface and undesirable discolouration as a result of scorching, may occur, whereas if insufficient energy is applied, a discernible image will not be formed.

A number of factors govern the extent to which the image sought to be applied is actually visible or discernible. The principal factors so far identified are:

(1) the amount of laser energy impinging on unit area of the target region of the paper;

(2) the size of the image (in general, a large image will be more readily seen than a small image);

(3) the colour or shade of the paper being imaged (the image will in general show up better in reflected light against a coloured background than against a white background);

(4) the moisture content of the paper;

(5) the effect of coating with microcapsules (the microcapsule coating may partially obscure the image, or the aqueous suspension in which the microcapsules are normally applied may partially smooth down the fibre disturbance produced by the laser energy—whilst these effects have been noticed, it has been found, contrary to what might have been expected, that neither of them is particularly severe in practice).

(6) the type of laser used, i.e. whether it is a pulsed laser or a continuous wave laser.

(7) the manner in which the image is viewed (i.e. whether it is viewed in reflected or transmitted light).

Taking all the above factors into account, it has been found that in order to obtain an image of sufficient size to be reasonably legible on base paper as currently used in commercial production of pressure-sensitive copying paper, the laser and the associated focussing equipment should be capable of providing an energy density on the paper to be imaged of at least about 1.7 or 1.8 joules $cm^{-2}$, depending to a certain extent on image size and paper colour.

Whilst the energy densities quoted above represent an approximate lower threshold for an acceptably visible mark (for this particular paper), better results are obtained at higher energy densities, for example at energy densities (on the paper to be marked) in the range 1.9 to 5.0 joules $cm^{-2}$ for pulsed lasers and 2.2 to 4.8 joules $cm^{-2}$ for continuous wave lasers, depending in part on web speed. The upper limits of the ranges just quoted do not represent a threshold above which scorching necessarily occurs. A pulsed carbon dioxide laser having a maximum power output of the order of 2.5 to 5.0 kW or a continuous wave laser having a maximum power output of the order of 1 to 3 kW (depending on web speed), will normally be suitable for achieving the energy densities quoted above, when used with suitable focussing equipment.

Pulsed lasers of the kind supplied for the marking of packaging materials by such companies as: Laser Applications Limited of Hull, England; J.K. Lasers Limited of Rugby, England; and Lumonics Inc. of Kanata, Ontario, Canada, and a continuous wave laser of the kind sold as an Electrox Industrial Laser by Electrox Ltd. of Stotfold, near Hitchin, England, are examples of suitable commercially available lasers for use in the present invention.

It has been found that the moisture content of the paper to be imaged influences both the clarity of the mark formed at a particular energy density and the threshold energy intensity required for imaging. At low moisture contents, for example 3% moisture by weight, acceptably clear images have not so far been obtained, even at a pusled laer energy density on the paper of 5 joules $cm^{-2}$. Increasing the moisture content has been found to result in images of improved clarity. Above about 4% moisture content by weight, acceptable images were obtained in the higher part of the 1.9 to 5.0 joules $cm^{-2}$ range referred to above and the image quality improved with increasing moisture content. Less clear images were obtained in the lower part of the 1.9 to 5.0 joules $cm^{-2}$ energy range, but image quality improved at these lower energies when the moisture content was above about 6% by weight. These effects mean that moisture content can be used as a control parameter in the imaging operation, in addition to energy density. This offers the potential of reduced energy usage, and also enables images to be obtained with a reduced amount of lifting of fibres from the paper. Such lifting is potentially disadvantageous with respect to the subsequent microcapsule coating operation, as it can lead to gaps in coverage of the paper by the coating composition at or adjacent to the imaged areas of the paper. Taking all the factors just described into account, the preferred operating parameters are an energy density on the paper of about 2.1 joules $cm^{-2}$, say 2.0 to 2.2 joules $cm^{-2}$, for a pulsed laser, or 2.2 to 4.8 joules $cm^{-2}$, for a continuous wave laser and a paper moisture content of at least 6% by weight, for example 6 to 8% by weight. In the case of a continuous wave laser the beam energy may fluctuate, and in order to allow a margin of error and minimise the possibility of images sometimes not being produced, a higher energy density than the lower figure just quoted is desirable, for example 3.5 joules $cm^{-2}$.

The laser imaging operation may be carried out as part of the operation in which the paper is produced or is coated with microcapsules. For example, the laser may be positioned at the dry end of the papermachine or at or adjacent the reel unwind station of the coating machine at which the microcapsule coating is applied, or, in the case of in-line microcapsule coating, between the dry end of the papermachine and the microcapsule coating head. The moisture content of the paper will vary at different locations, and the position chosen for imaging should take this into account.

The web speed at which imaging may be carried out may vary widely. Marking at web speeds up to 550 m $min^{-1}$ has so far been achieved, but it is not thought that this represents an upper limit, since spinning discs of paper have been clearly marked at a speed equivalent to a linear web speed of 2,800 m min−1 (using manually-induced pulses of laser energy).

The image repeat frequency may in principle be varied within broad limits. For example, the frequency may be such as to give one mark per sheet (e.g. an A4 or A5 size sheet) if the paper is eventually to be sheeted. If the paper is to be used initially in reel form, the marks may be applied at longitudinal spacings corresponding to A4 or A5 or other desired spacings, although equipment constraints may preclude the obtaining of too closely-spaced marks.

The present invention is applicable to both white and coloured papers. With white papers there is a "white on white" effect, the whiteness of the image contrasting with that of the unmarked paper. With coloured papers, the image normally appears as white against the coloured background in reflected light. The additional contrast which this affords tends to mean that the energy density required to produce acceptably visible marks on most coloured papers (excepting perhaps yellow papers) is rather less than that needed for producing acceptably visible marks on white papers.

The microcapsule coating operation may be carried out by the techniques conventionally used in the manufacture of pressure-sensitive copying paper, for example reverseroll, air knife or flexographic coating, and the microcapsule coatweight may also be conventional (say 4 to 6 $gm^{-2}$ dry coatweight).

The invention will now be illustrated by the following examples:

EXAMPLE 1

In this Example a 20 Hz (nominal value) pulsed carbon dioxide laser of 2.5 joule maximum emergy output was used to image a 48 g $m^{-2}$ white paper web of the kind used in pressure-sensitive record material, after which the web was reverse-roll coated on a pilot scale coater with an aqueous microcapsule-containing coating composition of the kind used in pressure-sensitive record material at a wet coatweight of approximately 20 g $m^{-2}$ (5 g $m^{-2}$ dry). The laser was positioned between the unwind station and the coating head of the coater. An apertured mask was positioned in the path of the laser beam, so as to allow laser energy through in an image configuration. A lens was used to focus the image to give an image size of 9×4 mm.

The web was run at a range of speeds from "crawl" to 550 m $min^{-1}$, the total length of web imaged being more than 5000 m. At all speeds the image had good definition and consistency prior to coating. Coating reduced the definition and consistency of the image, but did not obscure it, and the image was of acceptable quality. The target image repeat distance was 420 mm, and this was largely achieved except below about 150 m $min^{-1}$ web speed.

The microcapsule coated paper was tested for functional performance by utilizing the paper as the top sheet of a pressure-sensitive record material couplet, and this performance was found to be satisfactory.

EXAMPLE 2

This Example was generally similar to Example 1, but a white web of higher grammage was used (72 g $m^{-2}$ instead of 48 g $m^{-2}$) and the image size was 11.9×5.9 mm. The web speed ranged from 300 to 500 m $min^{-1}$. The definition of the image once it had been coated with microcapsules was found to be substantially similar to that prior to coating. The microcapsule-coated paper was tested as before and found to be satisfactory.

EXAMPLE 3

This Example was also generally similar to the previous Examples, but blue and yellow 48 g $m^{-2}$ base papers were used instead of a white base paper. The image size and web speeds were as in Example 2. The images obtained were white, and thus afforded a constrast with the unimaged area of the paper. The contrast was much more noticeable for the blue paper than for the yellow. The microcapsule-coated paper was tested as before and found to be satisfactory.

EXAMPLE 4

This Example illustrates how the image formed by laser energy varies at a range of energy levels and paper grammages.

The images were made on individual sheets of paper of a range of grammages using a 20 Hz pulsed carbon dioxide laser of 5.0 joule maximum energy output, and an apertured mask and focussing lens as generally described in Example 1, and the laser was manually triggered. The image size was varied to achieve an energy density (on the paper) of from below 1.8 joules $cm^{-2}$ to 5.0 joules $cm^{-2}$ for paper of 48 g $m^{-2}$ grammage, and from 1.9 to 2.5 joules $cm^{-2}$ for papers of higher grammage (52, 62, 72, 82, 92 and 94 g $m^{-2}$). The moisture content of all these sheets was approximately 6% by weight.

It was found that an energy density of below 1.8 joules $cm^{-2}$ represented an approximate minimum threshold for visible image formation. Visible images were always obtained at an energy density on the paper of 1.9 joules $cm^{-2}$ to 2.5 joules $cm^{-2}$ although the clarity and edge definition of the image were not very good in the lower part of this range. Energy densities in the range 2.5 to 5.0 joules $cm^{-2}$ gave images of good visibility, but the definition of these images tended to fall off as the energy density increased above 2.5 joules $cm^{-2}$, possibly because the energy caused excessive disruption of the fibrous structure of the paper.

EXAMPLE 5

This example illustrates how the image formed by laser energy varies at a range of paper moisture contents and two different energy densities.

The laser used was as described in Example 1 with the laser energy output restricted to 1.5 joules. Two image sizes were employed, namely 13.8×5.7 mm, and 11.9×5.9 mm, corresponding to energy densities of 1.85 and 2.1 joules $cm^{-2}$ respectively. The grammages of the papers used were 48, 52, 62, 72, 82, 92 and 94 g $m^{-2}$, and the moisture content range was from 3% to 9% by weight.

It was found that whatever the energy density and image size, images of poor quality were always obtained below a moisture content of about 4% by weight. With the smaller image (i.e. higher energy density), acceptable images were obtained at and above this moisture content, the image becoming better as the moisture content increased. With the larger image (i.e. lower energy density), acceptable images were obtained only at a minimum moisture content of about 6%.

EXAMPLE 6

In this Example, a continuous wave carbon dioxide 1 kW laser was used to image a range of papers as used in the manufacture of pressure-sensitive copying paper at different web speeds on a prototype test rig, as follows:

| Paper Type | | |
|---|---|---|
| Grammage ($gm^{-2}$) | Colour | Web Speed ($m\ min^{-1}$) |
| 48 | white | 300 |
| 63 | " | 350 |
| 45 | " | " |
| 57* | " | " |
| 48 | blue | 400 |
| " | green | " |
| " | pink | " |
| 57* | blue | " |
| 57* | green | " |
| 57* | pink | " |

*These papers had a clay-based colour developer coating on their surface opposite to that being imaged. The imaged paper surfaces were uncoated in all cases.

The image size in each case was 5×12.5 mm. After imaging, the imaged surface of the paper was coated with an aqueous microcapsule-containing composition, as generally described in Example 1. The images obtained in each case were clearly visible through the microcapsule layer in transmitted light, and the functional performance of the paper in a pressure-sensitive copying set was found to be satisfactory. The images on the coloured papers were also clearly visible in reflected light.

I claim:

1. A method of producing an imaged paper, comprising the steps of (1) applying laser energy to a surface of paper having a moisture content above about 4 wt. % and dry to conventional paper manufacturing levels, thereby forming an image with disrupted surface fiber structure, said laser energy having an intensity such that at least one of the light-transmitting and light-reflecting characteristics of the paper are affected, and (2) applying a microcapsule coating over said paper surface after application of said laser energy, said coating covering, but not obscuring, said image.

2. A method of producing an imaged paper, comprising the steps of (1) applying laser energy to a surface of paper having a moisture content above about 4 wt. % and dry to conventional paper manufacturing levels, thereby forming an image with disrupted surface fiber structure, and (2) applying a microcapsule coating over said paper surface after application of said laser energy, said coating covering, but not obscuring, said image and said laser energy in step (1) having an intensity such that the fibers of said paper are not substantially scorched or lifted to an extent such as to give rise to gaps in coverage of the paper when the microcapsule coating is applied.

3. A method as claimed in claim 2, wherein the density of the laser energy on the paper substrate is at least 1.7 joules $cm^{-2}$.

4. A method as claimed in claim 3, wherein the density of the laser energy on the paper substrate is at least 1.8 joules $cm^{-2}$.

5. A method as claimed in claim 4, wherein the density of the laser energy on the paper substrate is at least 1.9 joules $cm^{-2}$.

6. A method as claimed in claim 5, wherein the laser energy is from a pulsed laser and the density of the laser energy on the paper substrate is in the range 1.9 to 5.0 joules $cm^{-2}$.

7. A method as claimed in claim 6, wherein the density of the laser energy on the paper substrate is from 2.0 to 2.2 joules $cm^{-2}$ and the moisture content of the paper substrate is from 6% to 8% by weight.

8. A method as claimed in claim 5 wherein the laser energy is from a continuous wave laser and the density of the laser energy is from 2.2 to 4.8 joules $cm^{-2}$.

9. A method as claimed in claim 1 wherein the paper substrate is imaged by means of a laser energy source mounted on the paper machine on which the paper substrate is produced or on the paper coating machine on which the paper substrate is subsequently microcapsule coated, whereby the speed of the paper substrate during imaging is the same as the speed at which the paper substrate is manufactured or coated with microcapsules.

10. A method as claimed in claim 9, wherein the imaged paper is a microcapsule-coated pressure-sensitive copying paper.

* * * * *